US005980400A

United States Patent [19]

Schickert

[11] Patent Number: 5,980,400

[45] **Date of Patent: *Nov. 9, 1999**

[54] COMPRESSION MOLDED BASKETBALL COMPONENTS WITH INMOLD GRAPHICS

[75] Inventor: Randy R. Schickert, Kewaskum, Wis.

[73] Assignee: Huffy Corporation, Miamisburg, Ohio

[ * ] Notice: This patent is subject to a terminal disclaimer.

[21] Appl. No.: 08/710,384

[22] Filed: Sep. 16, 1996

Related U.S. Application Data

[63] Continuation-in-part of application No. 08/593,322, Jan. 31, 1996, and application No. 08/190,914, Feb. 13, 1994, Pat. No. 5,626,339.

[51] Int. Cl.[6] ..... A63B 71/02

[52] U.S. Cl. ..... 473/481

[58] Field of Search ..... 473/479, 481; 52/309.4, 309.8, 309.9; 101/129

[56] References Cited

U.S. PATENT DOCUMENTS

| | | |
|---|---|---|
| Re. 25,938 | 12/1965 | Mobley . |
| D. 264,740 | 6/1982 | Merino et al. . |
| T984,007 | 7/1979 | Richardson . |
| 1,043,387 | 11/1912 | Astruck . |
| 1,270,004 | 6/1918 | Chappell . |
| 1,570,403 | 1/1926 | Ripczinske . |
| 1,631,227 | 6/1927 | See . |
| 1,950,196 | 3/1934 | Slusher . |
| 1,988,037 | 1/1935 | Furrer . |
| 2,457,908 | 1/1949 | Meyerhoefer . |
| 2,483,734 | 10/1949 | Neal . |
| 2,586,724 | 2/1952 | Sannebeck . |
| 2,818,254 | 12/1957 | Dunn . |
| 2,916,184 | 12/1959 | Hartley et al. . |
| 2,986,395 | 5/1961 | Sheftel . |

(List continued on next page.)

FOREIGN PATENT DOCUMENTS

| | | |
|---|---|---|
| 952674 | 8/1974 | Canada . |
| 605246 | 5/1926 | France . |
| 1215242 | 4/1960 | France . |
| 2234942 | 2/1973 | Germany . |
| 2920903 | 12/1980 | Germany . |
| 609018 | 9/1960 | Italy . |
| 46-9959 | 12/1965 | Japan . |
| 42-6183 | 3/1967 | Japan . |

(List continued on next page.)

OTHER PUBLICATIONS

Huffy Youth Sports styrene basketball board (admitted prior art).

SureShot polystrene, structurally foamed basketball backboard (admitted prior art).

Huffy Sports Product Brochure, "Center Court Portables" (9H421—Tuff Stuff; 9H331—Zero Gravity; 9H366—Zero Gravity; 9H335—Get Vertical) (admitted prior art).

Sportime catalog, 1993 Summer Edition, p. 135, Cast Aluminum Fan–Shaped Backboard (Sep. 1993).

Plastics World, Feb. 1963,, Hochner, W.L., "In–Mold Decoration" pp. 24–25.

*Primary Examiner*—Raleigh W. Chiu

*Attorney, Agent, or Firm*—Howrey & Simon; Michael J. Bell

[57] ABSTRACT

Basketball backboards and other moldable plastic parts of basketball goal assemblies are formed of thermoplastic materials made in a compression molding process enabling use of an integrally molded graphics sheet. To produce the compression molded part with inmolded graphics, a peripheral edge of the printed graphics sheet is positioned to register with a positioning surface in the mold thereby aligning the graphics sheet relative to the mold. The graphics sheet bonds/melts with the base thermoplastic material during the molding operations and becomes a permanent inmolded graphics sheet surrounded by a border portion. The printed graphics sheet is formed of a material compatible with the thermoplastic material. A preferred thermoplastic material includes recycled plastic made from landfill-destined plastic and/or recycled glass fiber and/or other filler materials.

10 Claims, 8 Drawing Sheets

U.S. PATENT DOCUMENTS

| | | | |
|---|---|---|---|
| 3,072,969 | 1/1963 | Du Bois . | |
| 3,122,598 | 2/1964 | Berger . | |
| 3,137,502 | 6/1964 | Duganich . | |
| 3,270,101 | 8/1966 | Jardine et al. . | |
| 3,341,197 | 9/1967 | Bottorff . | |
| 3,401,774 | 9/1968 | Krahn . | |
| 3,546,748 | 12/1970 | Gardner . | |
| 3,669,450 | 6/1972 | Mason . | |
| 3,716,234 | 2/1973 | Lancellotti . | |
| 3,722,903 | 3/1973 | Jones . | |
| 3,806,398 | 4/1974 | Lasser . | |
| 3,841,631 | 10/1974 | Dolan . | |
| 3,900,194 | 8/1975 | Ward et al. . | |
| 3,908,992 | 9/1975 | Cunningham et al. . | |
| 3,964,743 | 6/1976 | Salsich, Sr. | 473/481 |
| 3,970,240 | 7/1976 | Van Leer . | |
| 4,016,235 | 4/1977 | Ferro . | |
| 4,095,825 | 6/1978 | Butler . | |
| 4,145,044 | 3/1979 | Wilson et al. . | |
| 4,286,409 | 9/1981 | Taylor et al. . | |
| 4,294,789 | 10/1981 | Lincoln et al. . | |
| 4,402,262 | 9/1983 | Handforth . | |
| 4,412,679 | 11/1983 | Mahoney et al. . | |
| 4,424,968 | 1/1984 | Smith . | |
| 4,478,415 | 10/1984 | Shaffer et al. . | |
| 4,583,732 | 4/1986 | Allen . | |
| 4,613,136 | 9/1986 | Raba et al. . | |
| 4,640,211 | 2/1987 | Namur . | |
| 4,731,279 | 3/1988 | Isshiki . | |
| 4,757,778 | 7/1988 | Scaglia . | |
| 4,759,545 | 7/1988 | Grable . | |
| 4,786,053 | 11/1988 | Barnes, Jr. . | |
| 4,793,611 | 12/1988 | Thornell . | |
| 4,826,162 | 5/1989 | Allen . | |
| 4,869,501 | 9/1989 | Anastasakis . | |
| 4,913,388 | 4/1990 | McCant . | |
| 4,917,927 | 4/1990 | Sakaitani et al. . | |
| 4,931,248 | 6/1990 | Willemin . | |
| 5,030,407 | 7/1991 | Mollet et al. . | |
| 5,039,468 | 8/1991 | Sellers . | |
| 5,061,428 | 10/1991 | Batchelder . | |
| 5,066,007 | 11/1991 | Niver . | |
| 5,082,261 | 1/1992 | Pelfrey . | |
| 5,098,092 | 3/1992 | Aakre et al. . | |
| 5,108,818 | 4/1992 | Ebina et al. . | |
| 5,112,023 | 5/1992 | Sowers . | |
| 5,145,153 | 9/1992 | Glynn . | |
| 5,158,281 | 10/1992 | Williams . | |
| 5,163,676 | 11/1992 | Taub . | |
| 5,207,407 | 5/1993 | Fitzsimmons et al. . | |
| 5,211,593 | 5/1993 | Schneider et al. . | |
| 5,224,699 | 7/1993 | Zaruba . | |
| 5,227,222 | 7/1993 | Ogawa et al. . | |
| 5,236,636 | 8/1993 | Tisack . | |
| 5,238,630 | 8/1993 | Tung . | |
| 5,248,140 | 9/1993 | Matherne et al. . | |
| 5,259,612 | 11/1993 | Matherne et al. . | |
| 5,264,172 | 11/1993 | Rosica et al. . | |
| 5,292,118 | 3/1994 | Allen et al. . | |
| 5,354,049 | 10/1994 | Matherne et al. . | |
| 5,354,053 | 10/1994 | Ratner et al. . | |
| 5,375,835 | 12/1994 | Van Nimwegen et al. . | |
| 5,377,976 | 1/1995 | Matherne et al. . | |
| 5,411,688 | 5/1995 | Morrison et al. . | |
| 5,415,393 | 5/1995 | Fitzsimmons et al. . | |
| 5,433,432 | 7/1995 | Adler . | |
| 5,470,054 | 11/1995 | Bohrman . | |
| 5,484,560 | 1/1996 | Moriyama et al. . | |
| 5,507,484 | 4/1996 | Van Nimwegen et al. | 473/481 |
| 5,512,227 | 4/1996 | Grazioli . | |
| 5,556,088 | 9/1996 | Mower et al. . | |
| 5,604,006 | 2/1997 | Ponchaud et al. . | |
| 5,626,339 | 5/1997 | Schickert et al. | 473/481 |

FOREIGN PATENT DOCUMENTS

| | | |
|---|---|---|
| 43-7458 | 3/1968 | Japan . |
| 5 3143-655 | 5/1977 | Japan . |
| 5 5034-913 | 9/1978 | Japan . |
| 5 1750-971 | 3/1981 | Japan . |
| 6 2140-807 | 6/1987 | Japan . |
| 2-244189 | 9/1990 | Japan . |
| 40/5084769 | 4/1993 | Japan . |
| 6706593 | 11/1967 | Netherlands . |
| 143168 | 9/1974 | Netherlands . |
| 19177 | of 1914 | United Kingdom . |
| 908055 | 10/1962 | United Kingdom . |
| 2 039 465 | 8/1980 | United Kingdom . |
| WO 95/26823 | 10/1995 | WIPO . |

COMPRESSION MOLDED BASKETBALL COMPONENTS WITH INMOLD GRAPHICS

This application is a continuation-in-part of each of the following applications, the disclosure of which is incorporated by reference herein: Ser. No. 08/593,322, entitled Portable Basketball Goal Support System With Separate Ballast Tank, filed Jan. 31, 1996, in the name of Randy R. Schickert, David A. Allen, Ronald A. White, Mark E. Davis and James N. Fitzsimmons; and Ser. No. 08/190,914, entitled Structural Foam Basketball Backboard With Inmold Graphics, filed Feb. 13, 1994, in the name of Randy R. Schickert and James N. Fitzsimmons U.S. Pat. No. 5,626,339.

BACKGROUND OF THE INVENTION

1. Field of the Invention

The invention relates in general to basketball backboards and other moldable, plastic parts of basketball goal assemblies and, more particularly, to basketball backboards and other parts of basketball goal assemblies formed of thermoplastic materials made in a compression molding process enabling use of an integrally molded graphics sheet.

2. Description of Related Art

Basketball backboards are currently made of a variety of materials and are commonly produced using a moldable plastic material. Compression molding has been a common method of producing basketball backboards and related parts of basketball goal assemblies for many years. Heretofore, compression molding of basketball backboards and related parts has been limited to thermoset materials, which is characterized by placement of a cold charge in a compression mold. Thermoset processed materials have certain drawbacks, including the fact that these materials are generally not recyclable other than as filler materials. In general, there are two basic types of compression molding processes which may be used for molding thermoplastics. The following description of these two processes outlines some of the difficulties that have prevented use of compression molded thermoplastics in the basketball goal assembly field.

The first type is a sheet molding process that involves placing a reinforcement, such as a glass mat, between sandwiching layers of a thermoplastic and heating the materials to produce a single sheet of material. The single sheet of material is then cut to the desired size and then reheated to molding temperature before being placed in a compression molding press. This process has the disadvantage of higher cost because of the apparatus required, the material handling costs incurred in making the sheet, handling and cutting the sheet, and the like. The material used to make the sheet is also subject to three thermodynamic cycles, a first cycle when the thermoplastic sheet is formed, a second cycle when the thermoplastic sheets and glass mat are molded together, and a third cycle when the resulting sheet is heated to molten temperature prior to molding the part.

The second form of thermoplastic compression is bulk molding compounds by producing a billet of molten material that is placed into a compression molding press which molds the molten material into a part. Effectively placing and distributing long reinforcing fibers in the billet has heretofore required complex machinery as discussed in detail in PCT International Publication Number WO 95/26823 having an International Publication Date of Oct. 12, 1995, the disclosure of which is incorporated herein by reference. Neither of these prior processes has been able to use post consumer recycled materials, which typically contain dissimilar, contaminated thermoplastics, without costly cleaning and processing that makes use of recycled thermoplastics impractical.

In addition, in recent years, it has become increasingly common to provide graphics on the front face of backboards for a variety of reasons, including aesthetic appeal to the consumer, product and source identification, etc. However, the only commercially acceptable methods of applying graphics have been silk-screening with inks or applying decals. Silk-screening is time consuming and the inks tend to fade after prolonged exposure to sunlight and the elements. Decals are also expensive and can peel off after time. An example of a prior art basketball backboard with silk-screened graphics is a backboard sold by a company known as "SureShot." The silk-screened SureShot backboard is 48 inches across and made of structurally foamed polystyrene molded in a multiple-port injection process. The backboard is molded in the natural color of polystyrene, which is a milky white color. The entire SureShot backboard is subsequently spray painted, both to seal the polystyrene and protect the backboard from ultraviolet radiation. Finally, graphics are silk-screened on the front face of the backboard.

To improve upon the graphics provided in basketball backboards, the assignee of this application has pioneered producing molded backboards with inmold graphics technology, which typically is accomplished by printing on a sheet or substrate using a full color printing process. This sheet is then placed in the mold and bonds/melts with base material during the molding operation and becomes a permanent "inmolded" graphics sheet. The advantage of this technology is the ability to print any image onto the sheet in one printing process (versus one silk-screen operation for each color) and the use of specially formulated inks that resist fading due to the sunlight and elements. This prior art inmold process was first introduced with polystyrene resin in a straight injection molding process.

Specifically, this first inmold process was used to produce a small backboard structure designed for youth sports, which was sold under the "Mini Jammer" name. The "Mini Jammer" backboard was formed by injecting styrene into a straight injection mold to form the styrene into the final desired shape of the backboard, which was small, i.e. less than 48 inches. The graphics display was printed on a styrene sheet laid by hand into the mold for forming the backboard. Alignment of the sheet was accomplished by aligning holes in the sheet on pins in the mold provided for producing the mounting holes in the backboard. Upon injecting styrene into the mold, the back portion of the graphics sheet melted to cause it to be integrally joined to the face of the backboard. As styrene is relatively easy to print on, its use in this prior art process was conducive to the production of backboards provided with sheets having graphics printed thereon.

In the parent application Ser. No. 08/190,914, an improvement of the prior inmold graphics process is disclosed that uses structural foam technology to mold backboards from polyolefin materials. The developments disclosed in this application greatly enhance the impact strength and structure (playability) of the backboard, thereby permitting the use of an inmold graphics sheet with larger backboards, such as 48 inches. In particular, this is accomplished by providing a basketball backboard formed of a structural foam plastic material, such as a polypropylene, molded in an injection molding operation. By molding the backboard using a structural foam material, the backboard is provided with an internal cellular structure and has a tough external skin, which provides good rebound characteristics. A printed graphics sheet formed of a material compatible with the backboard material, such as one formed of the same base resin material, is bonded to the backboard simultaneously with the molding operation of the backboard such that the graphics sheet is inmolded with the backboard structure. There is greater difficulty associated with printing on polyolefin materials than the prior art styrene material due to polyolefin-based materials being relatively non-porous and therefore not receptive to printing inks. To overcome this problem, the graphics sheet is corona treated prior to printing to produce pores in the sheet for receiving ink during printing.

The foregoing demonstrates that there is a need for a compression molding process for making basketball backboards and related basketball goal assembly parts from recyclable thermoplastic materials without requiring the extensive cleaning and processing that heretofore has made use of thermoplastics for these products impractical. There also is a need to further develop the inmold graphics process to permit its use in basketball backboards and other molded plastic parts of basketball goal assemblies made by compression molding thermoplastic resin materials.

SUMMARY OF THE INVENTION

The invention meets the above needs, and avoids the disadvantages and drawbacks of the prior art, by enabling the use of recyclable thermoplastic resins in a compression molding process compatible with inmold graphics. In particular, inmold graphics may be incorporated into the compression molding process by placing a printed graphics sheet face down horizontally in the lower fixed half of the compression mold. A positioning surface is provided in the mold to align the graphics sheet relative to the mold such that the outer peripheral edge of the graphics sheet is spaced from an inner periphery of the mold to form a border portion on the backboard between the outer peripheral edge of the graphics sheet and the inner periphery of the mold. An extruded hot billet or "charge" of plasticized, thermoplastic material is placed on top (back surface) of the graphics sheet. The mold then closes compressing the "charge" causing tremendous pressure and heat which cause the "charge" to melt, flow, and fill the cavity. At the same time, the "charge" bonds/melts to the backside of the printed sheet.

By this compression molding process, a component of a basketball goal assembly such as a basketball backboard is formed of compression molded plastic having graphics such as a sheet of graphics attached to the front face of the component.

The advantages of this technology are lower material costs and the ability to use dissimilar thermoplastic materials such as recycled plastic made from landfill-destined plastics and/or recycled glass fibers and/or other filler materials, in the molding process while maintaining high impact strength and structure (playability) of the backboard.

Other features and advantages of the invention will be apparent from the following description, the accompanying drawings, and the appended claims.

DETAILIED DESCRIPTION OF THE PREIFERRED EMBODIMENTS

Figure 1:
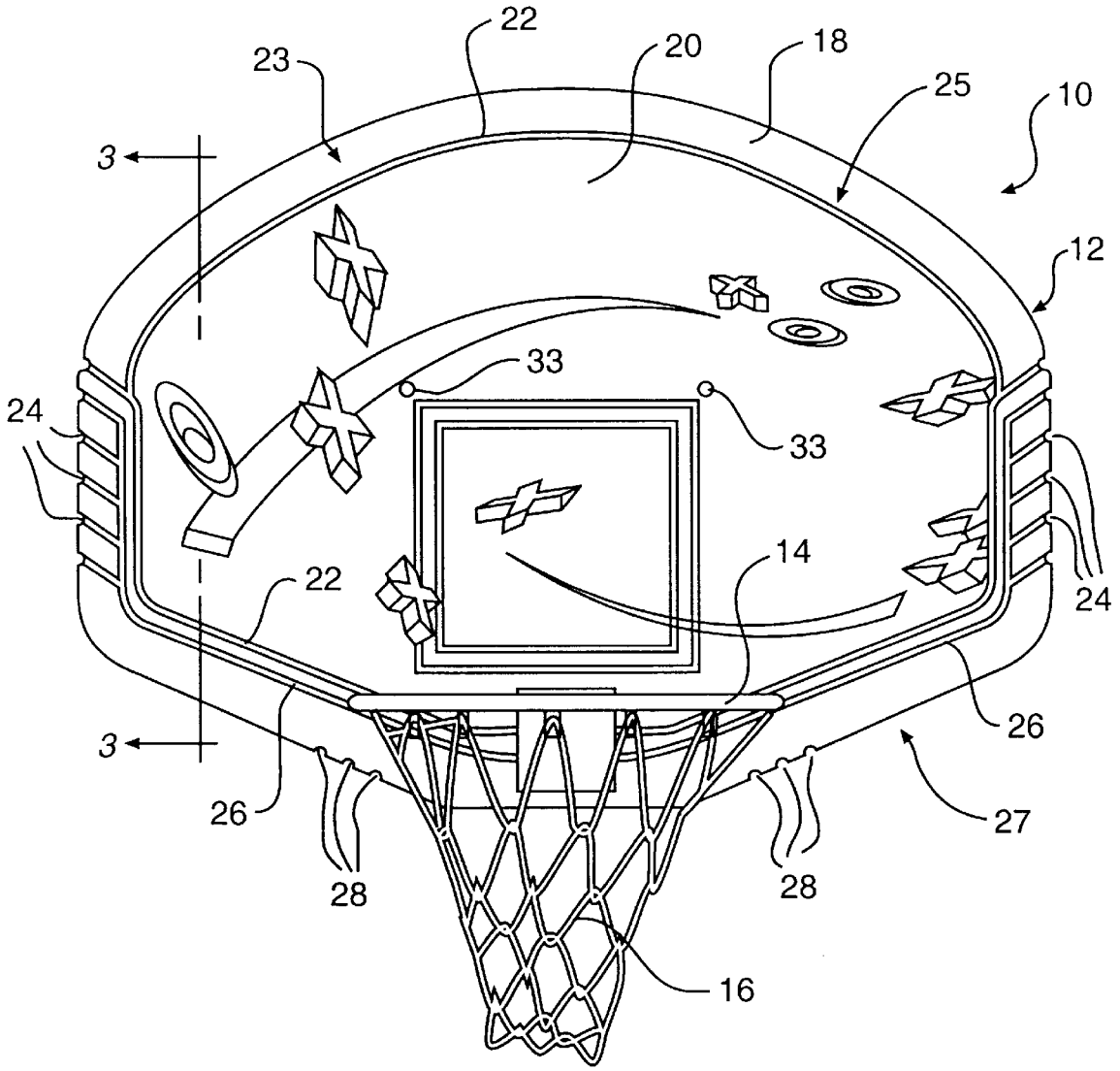
FIG. 1 is a front elevational view showing a backboard incorporating inmold graphics in accordance with the principles of the invention.

A basketball backboard goal assembly constructed according to the principles of the invention is shown generally at 10 in FIG. 1. Basketball goal assembly 10 includes a backboard 12 with a rim 14 including a net 16 mounted on a front face of backboard 12 in a conventional mamner, or it may be detachably mounted to the rim as part of a breakaway net attachment system as disclosed in the assignee's U.S. Pat. No. 5,524,883. Backboard 12 is compression molded from thermoplastic resin material with inmolded graphics.

More particularly, backboard 12 is formed from a backboard structure 18 inmolded with a thin graphics sheet 20 such that graphics sheet 20 is substantially integrally bonded to backboard structure 18 during molding. Graphics sheet 20 has an unprinted side bonded to backboard structure 18 and a printed side including graphics facing away from backboard structure 18 to be exposed on the front face of backboard 12. The graphics illustrated in FIG. 1 include X's, O's, sweep lines and a target box, however, any type of graphics can be provided on graphics sheet 20 during printing.

As shown, backboard structure 18 and graphics sheet 20 are each formed in substantially a fan shape. However, any alternative shapes and configurations such as a rectangular shape, for example, may be used as well. An outermost periphery of backboard structure 18 is larger than an outermost periphery 21 of graphics sheet 20 such that a border portion 23 of backboard structure 18 is exposed at the front face of backboard 12. Border portion 23 defines a surface 25 lying in substantially the same plane as the printed side of graphics sheet 20. Graphics sheet 20 is surrounded by a peripheral recess 22 formed by a positioning rib element projecting upwardly from one of the plates of the mold. As discussed below, the positioning rib element is provided to assist in positioning graphics sheet 20 during molding of backboard 20. Thus, peripheral recess 22 is located between an edge of outermost periphery 21 of graphics sheet 20 and border portion 23. Border portion 23 of backboard structure 18 surrounds peripheral recess 22.

Additional recesses may be formed on backboard structure 18 during molding to provide a three-dimensional sculpted appearance. A set of angled side edge recesses 24 is formed in border portion 23 on each lateral side of backboard 12. A set of lower edge recesses 28 is formed in border portion 23 on either side of rim 14 at a lower edge 27 of backboard 12. A curvilinear recess 26 extends between each set of edge recesses 24 generally parallel to peripheral recess 22 to form a double recessed appearance of the side and bottom of backboard 12. The recesses function as a further graphics enhancing feature for backboard 12 defining predetermined sculpted patterns on the front face of backboard 12. The cross-sectional shapes of recesses 22, 24 and 28 may be semi-circular, rectangular or any other shape capable of being formed during molding.

Functional features may also be provided in backboard 12 during molding. Optional mounting apertures 33 for mounting basketball backboard assembly 10 to a structure or pole are formed in backboard 12. Rim mounting apertures 34 (shown in FIG. 3) are formed in backboard 12 to receive fasteners, such as bolts, to attach rim 14 to backboard 12. Alternative configurations and details to achieve sculpted appearances and functional features can be provided in backboard 12 by modifying the plates of the mold used to produce backboard 12. Thus, any structure that may be integrally formed during molding to produce a sculpted pattern or appearance may be provided.

As will be discussed in greater detail in the following discussion, backboard structure 18 of the invention is compression molded from the following types of materials: thermoplastic resins, either virgin, recycled or a mixture of both, with a 100% landfill-destined thermoplastic formed from dissimilar thermoplastic materials and sold under the REDEX name by Composite Technologies Corporation of Dayton, Ohio, being the preferred thermoplastic material. Use of these materials in compression molding produces a high strength rigid backboard structure 18, which has sufficient rigidity and toughness to provide good rebound characteristics and resistance to weathering and can be successful employed for use in larger size backboards. In general, any material that can be made compatible for use in compression molding with inmold graphics technology may be used, but land fill-destined thermoplastics is currently preferred due to environmental and cost concerns.

Graphics sheet 20 is a thin sheet formed from a compatible material that is capable of being compression molded with the thermoplastic materials forming backboard structure 18. Although any compatible material that readily receives ink is acceptable, it is preferable to use a graphics sheet sold by PPG Industries of Cleveland, Ohio, under the TESLIN name, which is formed from cloth and plastic. In the alternative, where graphics sheet 20 is not inherently conducive to printing, the printed side of graphics sheet 20 may be subjected to a treatment process to prepare graphics sheet 20 for receiving print inks during the printing process, which is performed prior to placing graphics sheet 20 in the mold. An example of such a treatment process includes opening up a plurality of small pores on the side of graphics sheet 20 that is to be printed on by using a corona treatment, which imparts a positive charge to graphics sheet 20 to open the plurality of small pores. Graphics sheet 20 is then subjected to a printing process where printing ink is trapped within the small pores to provide the desired graphics appearance for graphics sheet 20. Additionally, the printed side of graphics sheet 20 may be coated with an ultra-violet (U.V.) coating, by, for example, a silk screen process, to form a laminate-like outer surface, which is resistant to the deleterious effects of the weather and sun.

Figure 2:
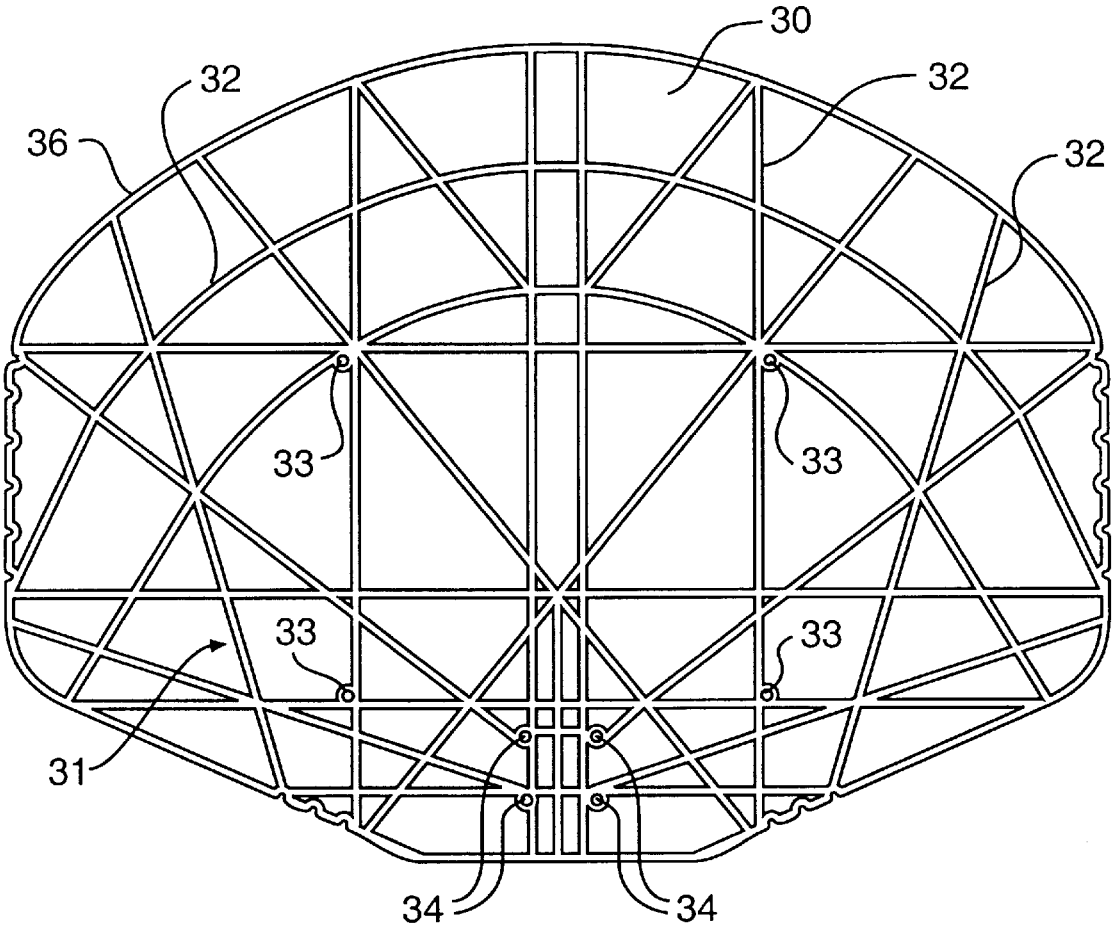
FIG. 2 is a rear elevational view of the backboard shown in FIG. 1.

Referring now to FIG. 2, a back side of backboard 12 is shown. The back side of backboard 12 shows backboard structure 18 including an integrally molded rib reinforcing structure, shown generally at 31, extending outwardly from a substantially planar surface 30. Backboard structure 18 is surrounded by an outer peripheral reinforcing rib 36 extending substantially perpendicularly outward from planar surface 30. Reinforcing ribs 32, which may be straight or curved, also extend substantially perpendicularly outward from surface 30. Reinforcing ribs 32 are positioned tangential to backboard mounting apertures 33 and rim mounting apertures 34 so that ribs 32 may comprise uninterrupted structures having more strength than intersecting ribs, as disclosed in parent application Ser. No. 08/190,914, the disclosure of which has been incorporated by reference herein. Although a particular pattern of ribs 32 is shown, other patterns may be used by modifying one of the plates of the mold. For example, depending upon the type of materials and molding parameters used, backboard structure 18 may have enhanced strength characteristics thereby eliminating the need for one or more of the curved, horizontal and vertical ribs 32, which also reduces the material and manufacturing costs associated with producing backboard 12.

Figure 3:
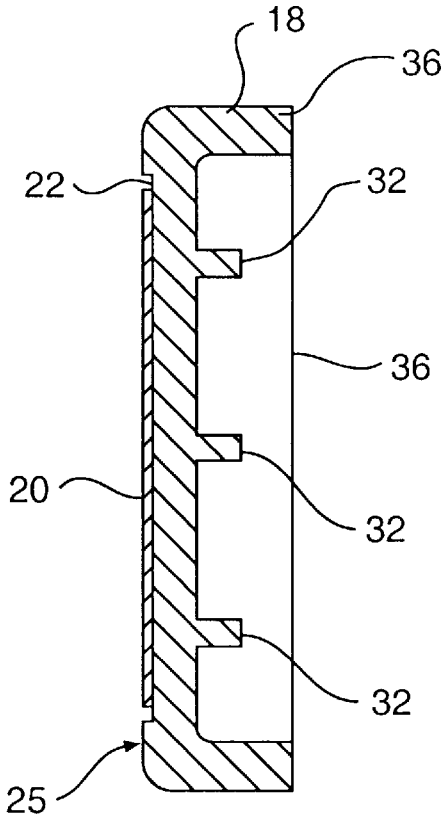
FIG. 3 is a schematic, cross-sectional view taken along line 3—3 in FIG. 1.

With reference to FIG. 3, a schematic cross-sectional view of backboard 12 taken along line 3—3 in FIG. 1 is shown to generally illustrate the relationship between backboard 12 and graphics sheet 20. Graphics sheet 20 and backboard structure 18 are shown as separate pieces for illustrative purposes, however, it is clear that during the molding process, graphics sheet 20 and backboard structure 18 melt together to form an integral unit without a distinct bond line as illustrated. Backboard structure 18, graphics sheet 20, rib 36 and ribs 32 are not illustrated to scale or in proportion. Additionally, the height and size of rib 36 and ribs 32 may be the same or vary relative to each other depending upon the particular characteristics desired.

Figure 4:
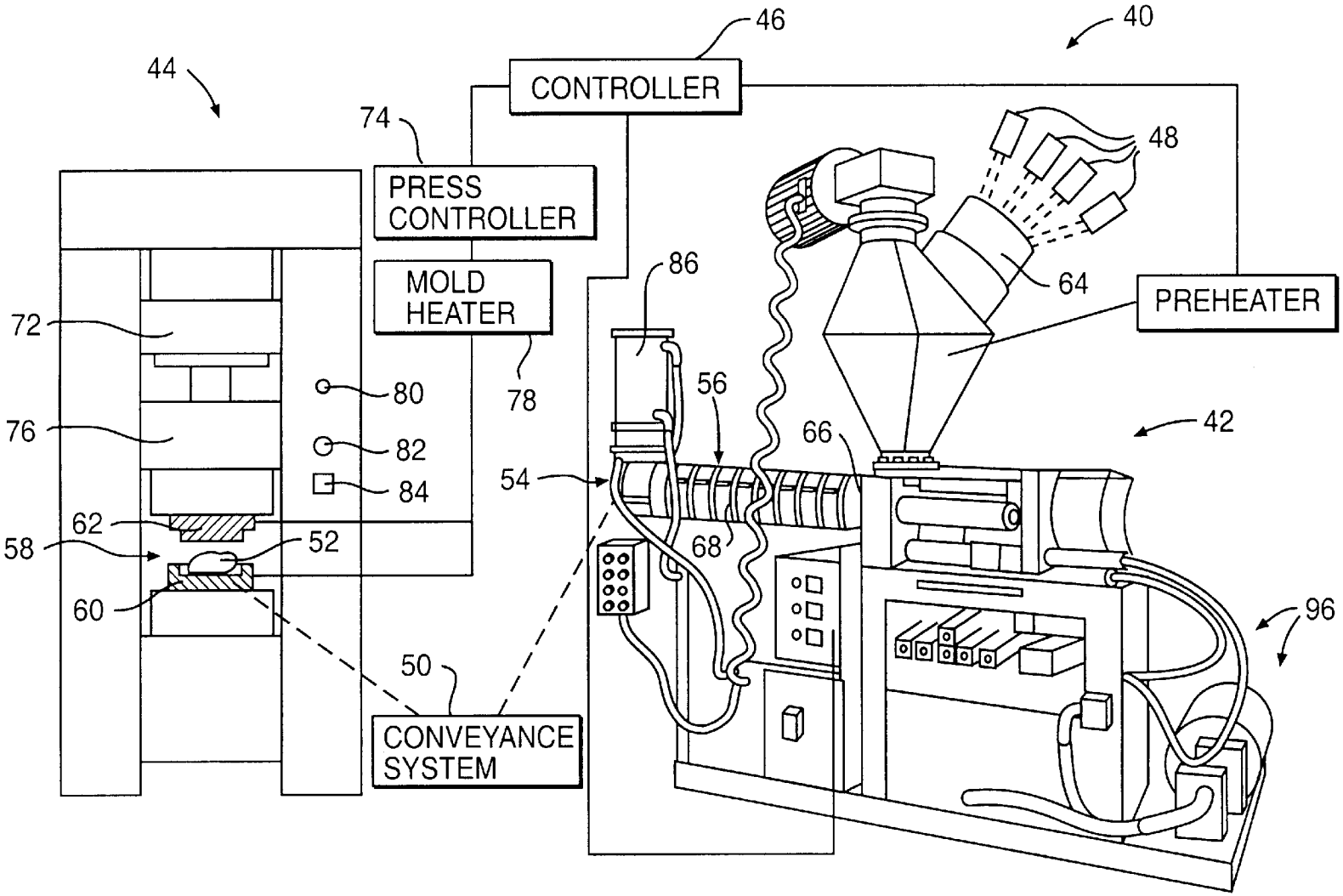
FIG. 4 is a view of a molding system for producing a compression molded part in accordance with principles of the invention.

FIG. 4 illustrates an apparatus for compression molding a part of a basketball goal assembly from thermoplastic materials with inmolded graphics, for example, backboard 12 discussed above. As will be discussed in greater detail in the following, other types of parts for basketball goal assemblies may be formed in the same manner.

More specifically, FIG. 4 illustrates a system 40 including, generally, a plasticator 42, a press 44, a conveyance system 50 and a controller 46. The following discussion provides a general description of these parts, which are disclosed in more detail in WO 95/26823, the disclosure of which has been incorporated herein by reference. Plasticator 42 serves the purpose of plasticating thermoplastic molding materials 48 into a billet 52 having predetermined characteristics. Press 44, associated with plasticator 42, receives billet 52 via conveyance system 50. Press 44 compression molds billet 52 with graphics sheet 20 into backboard 12. Controller 46 controls the operation of plasticator 42 and press 44.

The Plasticator

Plasticator 42 includes, generally, a barrel 56 housing a screw (not shown) for feeding, blending and extruding molding materials 48; and a control system to control the pressure and temperature in barrel 56 of plasticator 42 to create billet 56 having certain predetermined billet characteristics such as volume, density and temperature.

Plasticator 42 is capable of compatibilizing various contaminated thermoplastics to allow use of post consumer, landfill destined recycled material by providing a compounding and fabrication environment that promotes chemical bonding and molecular orientation to enhance the characteristic of the final molded part, e.g. backboard 12.

Plasticator 42 receives a plurality of molding materials 48 comprising predetermined amounts of polyester. Barrel 56 comprises a feed end 66, a blending portion 68 and an extruding end 54. A feed hopper 64 for receiving molding materials 48 is coupled to feeding end 66 of barrel 56. Extruding end 54 may include a dye to allow billet 52 to be extruded into a predetermined shape or diameter. The screw is rotatably and axially mounted within barrel 56. The screw has a plurality of threads that vary respectively along the length of the screw to achieve the necessary blending of molding materials 48.

Plasticator 42 also comprises a screw drive system 96 for rotatably and axially driving the screw in barrel 56. Screw drive system 96 controls the rotational and axial movement of the screw in barrel 56 in order to facilitate mixing of molding material 48 into a molten suspension using only one thermal heat rise and ultimately, into billet 52 having certain predetermined characteristics. When the mixed molten suspension achieves the predetermined characteristics, such as a predetermined volume, density, viscosity or size as indicated by a predetermined temperature and pressure, then the screw is withdrawn axially from barrel 56 to permit the suspension to be formed into billet 56 at extruding end 66 of barrel 56. Screw drive system 96 controls the rotational speed of the screw and the axial movement of the screw until the desired predetermined characteristics are achieved. By having the ability to control the pressure; the density, volume and viscosity of the molten suspension and billet 52 can be accurately controlled and made to conform to the desired material characteristics.

The Press

Press 44 includes a press driver 72 that is coupled to a press controller 74 which may also be coupled to controller 46 through press controller 74 energizes press driver 72 to drive platform 76 from an open or non-molding position shown in FIG. 4 to a closed or molding position (not shown). Platform 76 includes upper plate 62 of mold 58 which cooperates or mates with complementary lower plate 60 to mold, for example, backboard 12. In this embodiment, press 44 is a compression press such as the 250 ton Bipel Press, manufactured by Bipel of England, and press controller 74 may comprise a controller provided Allen Bradley, which may be coupled to controller 46.

Press 44 also comprises a mold heater 78 coupled to press controller 74 which is capable of controlling the temperature of controlling the temperature of upper and lower plates 62 and 60 of mold 58 when they are molding the backboard. In this embodiment, mold heater 78 can vary the temperature of lower plate 60 and upper plate 62 of mold 58 from approximately 30° F. to 350° F. depending upon molding materials 48 being used. It is to be noted that press 44 is a compression press which includes a pressure regulator 80 for regulating the pressure delivered to billet 52. In the embodiment being described, the pressure can vary from a 0 psi to 4,000 psi. Press 44 also comprises a pressure gauge 82 and a timer 84 for displaying the pressure and mold time, respectively, during corresponding operation of press 44.

The Conveyance System

The conveyance system 50 positions billet 52 in lower plate 60 and, if present, on graphics sheet 20 in lower plate 60 of mold 58 in press 44 after billet 52 is extruded from 54 on the end of plasticator barrel 56. Any suitable conveying system can be used as discussed in WO 95/26823.

The Molding Materials

In accordance with the invention, molding materials 48 are preferably comprised of a polyester, a carbocylic or other carbocylics and a preselected filler. The polyester may include polyethylene terephthalate (PET), and the carbocylics may be an olefinic such as polycarbonate polypropylene (PP), polyethylene (PE) or ethylene vinyl acetate (EVA).

A preselected reinforcement or filler may include a reinforcing fiber, glass fiber, fly ash, clay, carbon or graphite fiber, shredded reinforce fiber composite material, or like materials.

A compatibility enhancing agent or agents, such as olefinic polymers grafted with polar functional moieties such as acrylic acid or maleic anhydride, may also be included as one of the molding materials 48 which is added into feed hopper 64. The types and use of such compatibility enhancing agent or agents are described in detail in WO 95/26823.

An advantage of system 40 is that it is capable of handling post-consumer molding materials or molding materials which have a relatively high degree of contamination. For example, the molding materials 48 may be commingled or contaminated polymeric material as typically found in the post-consumer waste stream. While the nature of contaminants and the percent of occurrence varies from lot to lot as a natural feature of waste materials, they do, on average, typically contain similar materials and in similar quantities. For example, post-consumer polyesters (collected in the waste stream as PET) used in this process may contain 90% PET, 5% HDPE, 2% PP, 0.5% EVA and the remainder contaminants, including such things as miscellaneous paper and aluminum scrap.

Method and Process

The method and process for using system 40 and for creating billet 52 will now be described. Again, the method and process of the plasticizer is discussed only to the extent necessary to understand the features of the invention and reference should be made to WO 95/26823 for a more detailed discussion.

To use system 40, molding materials 48 are introduced into feed hopper 64 and are plasticized in plasticator 42 to produce billet 52. Depending upon the part that is to be molded, for example, backboard 12, the predetermined characteristics of billet 52 are determined. Thus, the volume, density and length, for example, of billet 52 are determined. Specific billet characteristics used to produce a compression molded thermoplastic backboard 12 in accordance with the invention are provided in specific examples in the following discussion.

Once the billet characteristics are determined, the necessary parts of plasticator 42 are adjusted to a pressure which generally corresponds to the billet characteristics selected. Similarly, the necessary components in plasticator 42 are adjusted to correspond to the length and volume of billet 52 that is desired. In addition, the necessary adjustments are made to control the temperature.

Molding materials 48 are then introduced into feeding end 66 of barrel 56. The screw is operated such that molding materials 48 are gradually blended together into a mixed molten suspension. Molding materials 48 are heated as they pass through barrel 56. Once the molten suspension has reached the predetermined pressure the molten suspension is caused to be extruded through extruding end 54 of barrel 56. Controller 46 controls knife driver 86 to separate the molten suspension to produce billet 52.

Figure 5:
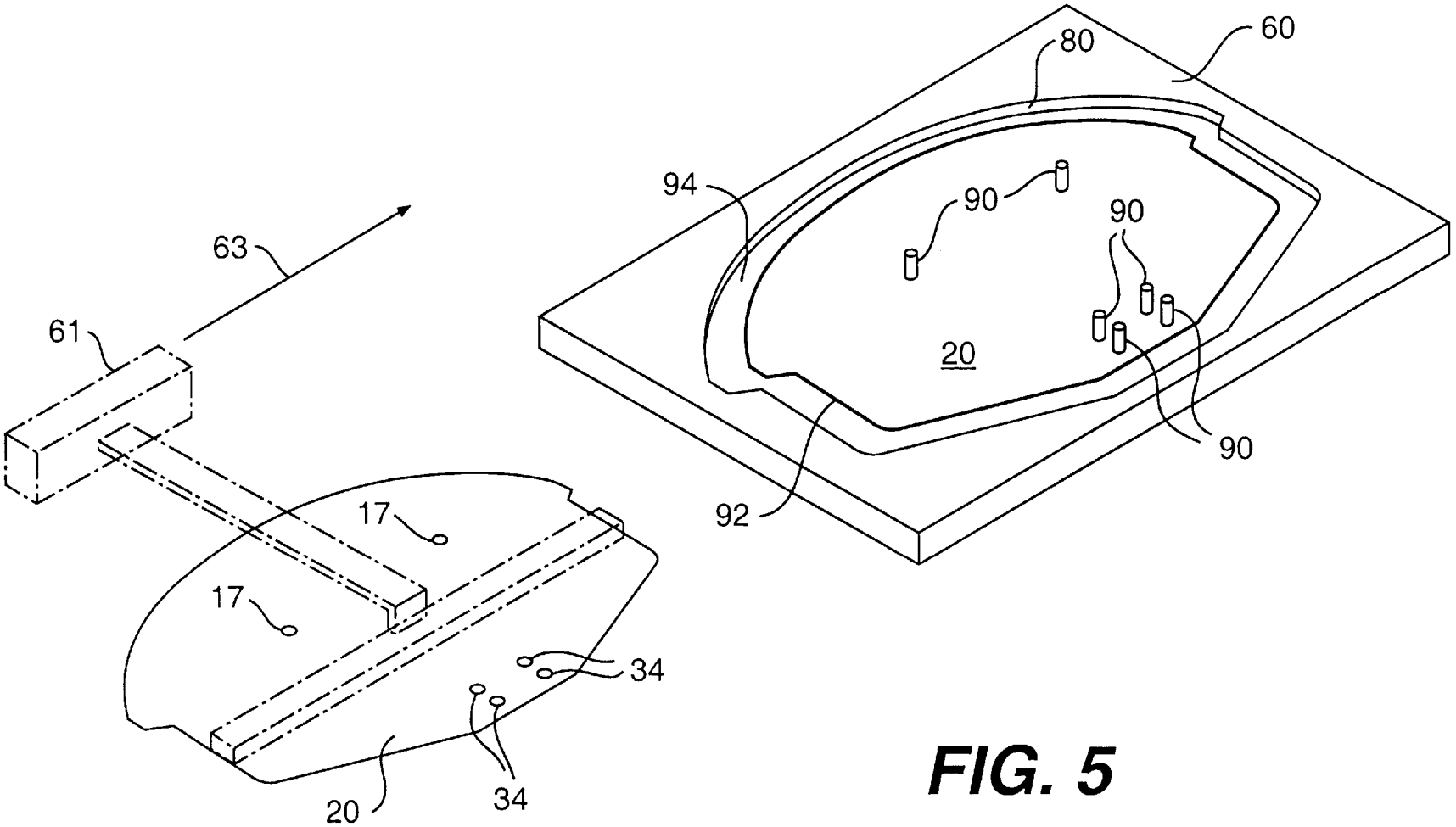
FIG. 5 is a schematic view showing positioning of a graphics sheet into a mold.
Figure 10:
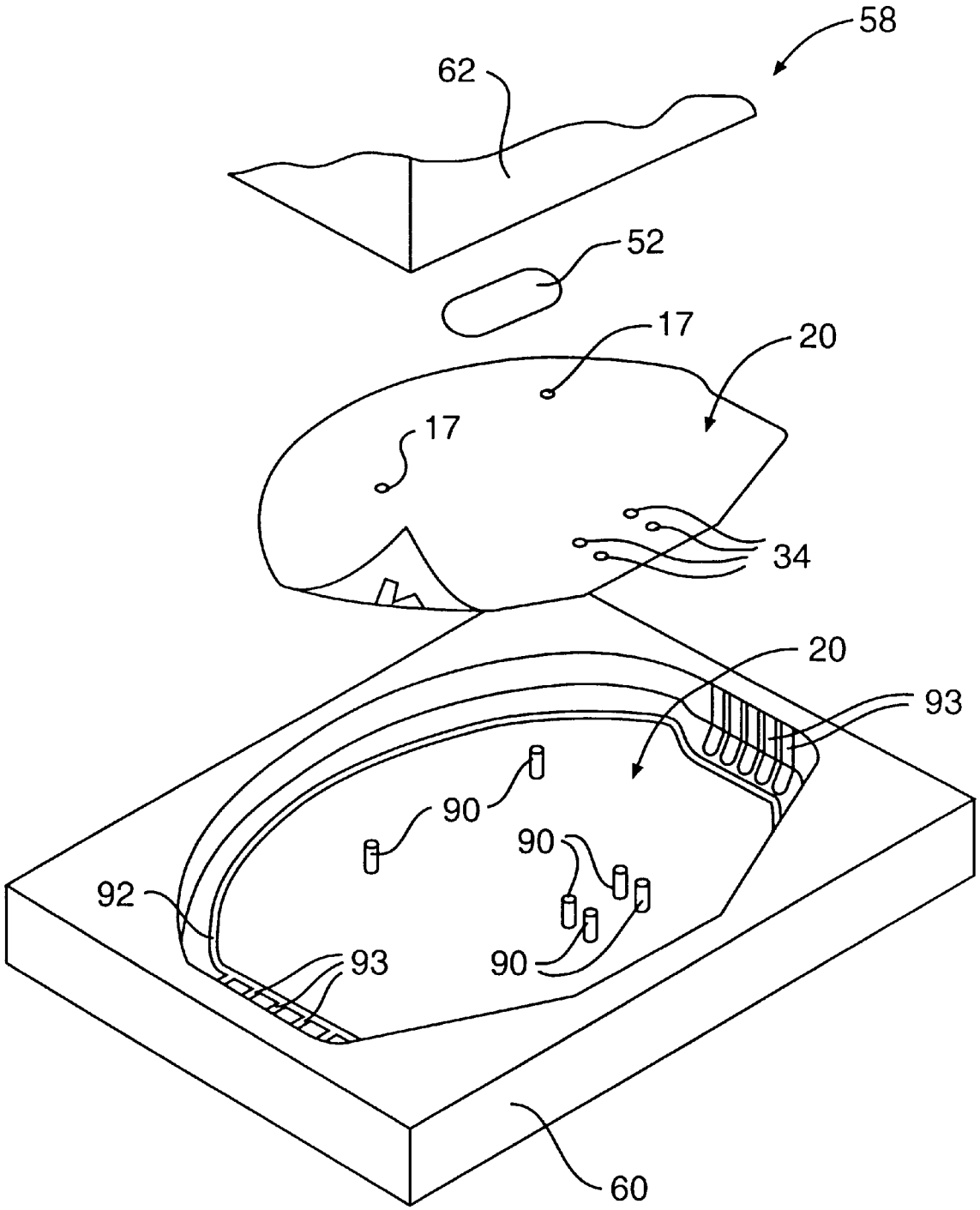
FIG. 10 is an additional schematic view showing positioning of the graphics sheet and billet into the mold.

To produce backboard 12 with inmold graphics, graphic sheet 20 is positioned in lower plate 60, which is constructed to form the front face of the backboard, prior to the introduction of billet 52 in mold 58 as is apparent from the schematic illustration of FIG. 5. FIG. 5 shows a generalized view of lower plate 60 of mold 58 used to form backboard 12. A somewhat more detailed view of lower plate 60 is shown in FIG. 10, which will be described with reference to the Example discussed in the following disclosure. As discussed above, graphics sheet 20 may be pretreated to receive inks, printed with graphics, and U.V. coated prior to being placed in the mold. After graphics sheet 20 is cut to the appropriate size, if necessary, then, graphics sheet 20 is moved in association with lower plate 60, preferably by an automated delivery means depicted diagrammatically as element 61, which is adapted to grip and move graphics sheet 20 to the desired location as shown by arrow 63. Graphics sheet 20 includes a printed side on a front face thereof and that the printed side is placed face down towards bottom surface 94 as graphic sheet 20 is placed within recess 80 of lower plate 60 of mold 58.

To aid in proper placement of graphics sheet 20 in lower plate 60 of mold 58, lower plate 60, or in the alternative upper plate 62 (not shown in FIG. 5), is provided with a positioning rib element 92 that conforms to the perimeter of graphics sheet 20 and extends upwardly from a bottom surface 94 of recess 80. The inner surface defined by positioning rib element 92 contacting the edge of graphics sheet 20 helps position graphics sheet 20 in lower plate 60 of mold 58. To further aid in proper placement of graphics sheet 20, positioning pins 90 may be provided in lower plate 60, for example, of mold 58. Corresponding positioning holes are formed in graphics sheet 20. These positioning pins 90 also function to form apertures 33 and 34, for example, for mounting rim 14 and/or backboard 12. By providing two or more pins/holes in lower plate 60/graphics sheet 20, slippage or rotation of graphics sheet 20 before or during the molding operation can be effectively prevented. Suitable positioning structures, such as those just explained are described in more detail in parent application Ser. No. 08/190,914.

In position, the printed side of graphics sheet 20 engages with bottom surface 94 and the outer peripheral edge of graphic sheet 20 is in contact with the surface defined by rib positioning element 92 around substantially the entire peripheral edge of graphic sheet 20. Thus, the graphics sheet is located in a predetermined position within the interior of mold plate 60. Other materials such as sheet coating material or reinforcement material may be also positioned in the mold prior to introducing billet 52.

In addition, bottom surface 94 of mold plate 60 may be provided with a rough surface using, for example, sand blasting. The rough surface serves to prevent slippage between lower plate 60 and graphics sheet 20 thereby keeping graphics sheet 20 from moving on lower plate 60. In the alternative, an electrical charge can be put on graphics sheet 20 causing graphics sheet 20 to adhere to lower plate 60. This electrical charge can be put on graphics sheet 20 before or after graphics sheet 20 is placed in mold 58. In either case, this step is important because graphics sheet 20 should not move during molding because this could produce an unattractive and sloppy result.

Billet 52 is then conveyed to lower plate 60 of mold 58 in press 44. Billet 52 is positioned on graphics sheet 20 in mold 58. Once billet 52 is located in press 44, controller 46 energizes press controller 74 to, in turn, energize press driver 72 to drive platform 76 downward (as viewed in FIG. 4) to cause the part, specifically backboard 12, to be molded.

Figure 6:
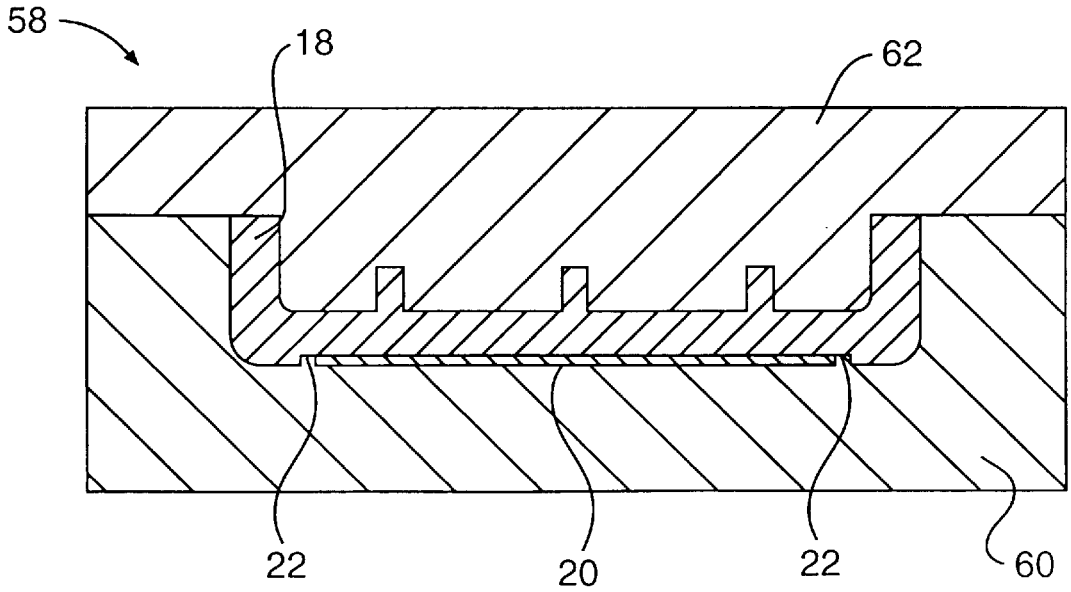
FIG. 6 is a cross-sectional view of a compression mold in the closed position molding a billet and a graphics sheet to form a backboard of the invention.

Referring now to FIG. 6, a cross-sectional view of mold 58 forming backboard 12 is shown in cross-section immediately prior to melting or bonding of graphic sheet 20 with backboard structure 18. Mold heater 78 then heats lower plate 60 and upper plate 62 of mold 58 to approximately 80° F. In addition, press 44 is set to compress billet 55 at, for example, approximately 3,000 psi with a controlled pressure gradient. When billet 52 is introduced into mold 58, because the molten plastic is very hot, it bonds with this back surface of graphic sheet 20. When the plastic cools, graphic sheet 20 is integrally formed on the front of backboard structure 18, for example. Then, the part is molded by press 44. Finally, backboard 12 is removed from press 44. To avoid the part sticking in the mold, the printed side of graphics sheet 20 that contacts mold 58 may be coated with an acrylic finish to prevent graphic sheet 20 from adhering to mold 58 during the molding process.

To avoid problems such as bowing or warping of the component as it cools during the molding operation, the graphics sheet should be formed of a material like TESLIN having the same or similar shrink rate when exposed to a molding operation as the shrink rate of the billet of thermoplastic material. In addition, forming the billet to be chemically compatible with the graphics sheet facilitates the bonding that occurs between these elements during the molding operation.

The invention will now be described with reference to a specific example which is to be regarded solely as illustrative and not as restricting the scope of the invention.

EXAMPLE

An illustration for molding backboard 12 will now be described with reference to FIG. 10. First, billet 52 is formed when plasticator 42 is charged with a mixture of about 83% mixed recycled thermoplastic polyolefins mentioned earlier, 1% compatibility enhancing agent, and 16% glass longer than one-quarter inch. The mixture is heated to a temperature of 450 degrees fahrenheit while being blended into the homogeneous billet 52 in plasticator 42 and is collected in the plasticator storage area at a pressure of 300 psi.

The backboard mold lower and upper plates 60 and 62 in the compression molding press are set to a temperature of about eighty degrees fahrenheit and the mold is prepared for molding the part, the backboard 12, by properly orienting a printed sheet of the aforementioned TESLIN with the printed side face down in lower plate 62. Lower plate 62 as shown includes positioning rib element 92 and projections 93 to form peripheral recess 22 and recesses 24, respectively, for example, as discussed earlier. The bottom surface of lower plate 60 is shown to be roughened as discussed earlier. Plasticator 42 is set to deliver about a thirteen pound billet 52 which is transferred by conveyor system to the press and placed atop the TESLIN graphics sheet 20. The compression molding press is then closed and delivers a pressure of about 2,000 psi for thirty seconds, at which time the pressure reduces to 500 psi for another thirty seconds. The press is then opened and the finished backboard 12 with the integrally molded graphics sheet 20 is removed from the press.

It should be appreciated that the upper and lower mold plates 62 and 60 are at a lower temperature (i.e., about 80 degrees fahrenheit) relative to billet 52 which is relatively much hotter (i.e., on the order of between 300 to 500 degrees). Because of this temperature differential, molten billet 52 tends to bond quickly to the back surface of sheet during the compression molding process. As the molten plastic or billet cools, graphics sheet 20 becomes integral with backboard structure. The temperature differential also facilitates melting the TESLIN at a rate such that it cools before melting graphics on surface.

After the backboard is molded, the backboard may be subsequently be mounted onto a suitable frame (not shown) which, in turn, is mounted on a pole or other support structure for supporting the backboard above the ground.

Although a preferred system 40 for producing a thermoplastic resin billet using plasticator 42 has been described above, the invention relates generally to compression molding a billet or charge of material, such as thermoplastic resin having predetermined characteristics, with an inmolded graphics sheet. Accordingly, any known process capable of molding a backboard or related basketball system parts from producing thermoplastic resins having the characteristics necessary for successful compression molding with inmold graphics capability may be employed.

In addition, although the thermoplastic compression molding process of the invention is capable of incorporating inmold graphics, as discussed above, it may be used advantageously without an inmolded graphics sheet to produce backboards and other components of basketball goal assemblies from thermoplastic materials, particularly dissimilar materials recovered from a recycling program.

Alternate Compression Molded Backboard with Inmolded Graphics

Figure 8:
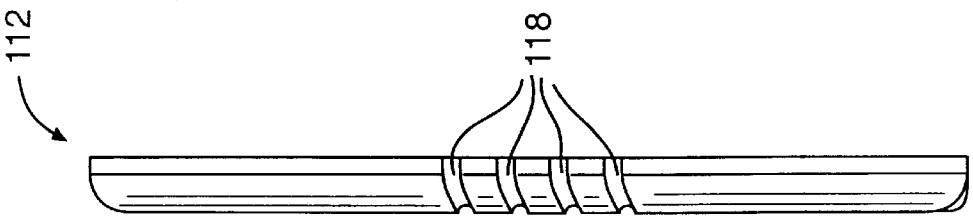
FIG. 8 is a side view of the backboard shown in FIG. 7.
Figure 7:
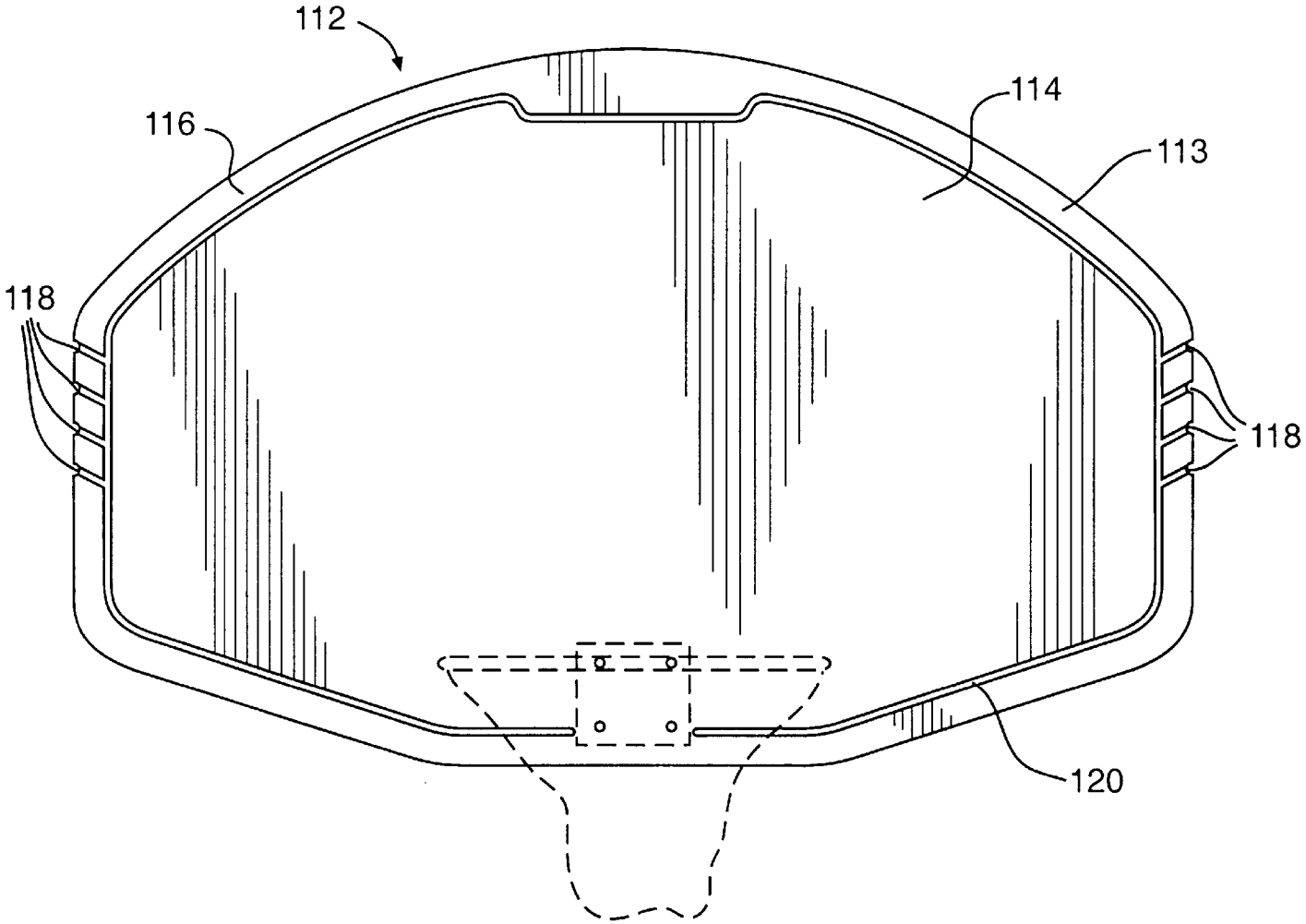
FIG. 7 is a front elevational view of an alternate embodiment of a backboard that may be made according to the principles of the invention.

FIGS. 7 and 8 show an alternate configuration of a compression molded backboard 112 including backboard structure 113 and an inmolded graphics sheet 114 (graphics not shown) made in accordance with the invention. A border portion 116 of backboard structure 113 includes angled recesses 118 and peripheral recess 120. Backboard structure 113 may be made from thermoplastic resin and graphics sheet 114 may be made from a compatible material, respectively, as discussed earlier.

Alternate Compression Molded Parts with Inmolded Graphics

Figure 9:
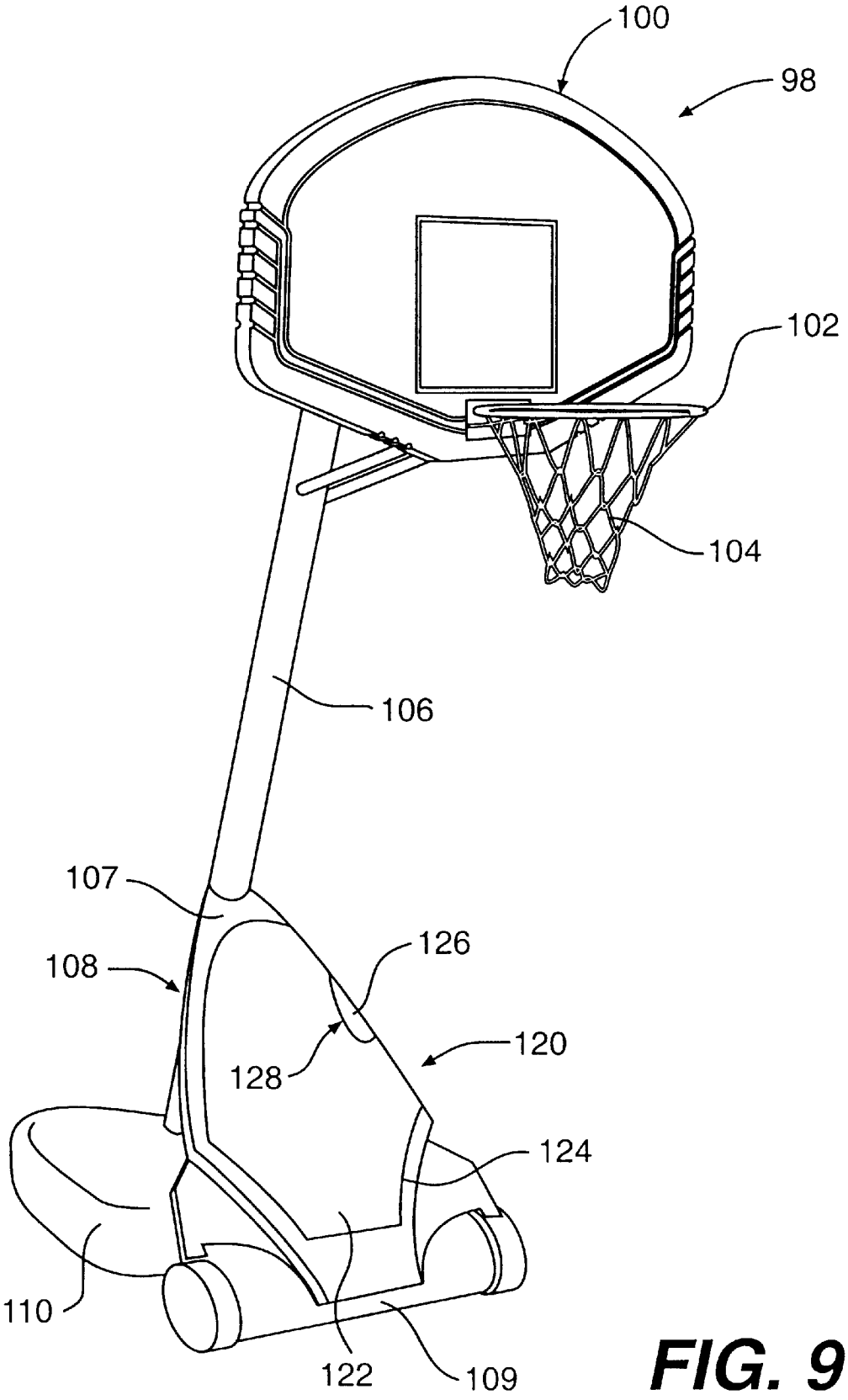
FIG. 9 is a view of a portable basketball goal assembly showing a compression molded support arm incorporating inmold graphics in accordance with the principles of the invention.

In another aspect of the invention, a printed graphics sheet may be integrally molded with one or more of the main components of portable basketball support system for a backboard goal assembly as shown generally at 98 in FIG. 9. The goal assembly includes a backboard 100, a rim 102 attached to backboard 100 and a net 104 attached to rim 102 in the manner discussed previously in connection with the FIG. 1 embodiment. The main components of the portable basketball system include a pole 106, which, in turn, is supported by support arm 108 pivotally mounted to a base 109 having a separate ballast tank 110. A graphics sheet can be bonded to any moldable, plastic part of portable basketball system 98 during the molding operation using the compression molding process described in detail earlier. For example, it is preferred that support arm 108, which is one of the most visible components during use, be formed by compression molding support arm structure 107 with inmolded graphics sheet 122 provided a substantially flat, front surface 120 of support arm 108. A peripheral recess 124 is formed in the mold by a positioning rib, which accommodates different shaped graphics sheets. Thus, the shape of peripheral recess 124 corresponds to the shape of the periphery of graphics sheet 122. Peripheral recess 124 may have a notch 128 to allow handle 126 molded in support arm structure 107 to be exposed. The compression molded support arm 108 may be made with thermoplastic resin and inmold graphics sheet 122 may be made from a compatible material, respectively, in accordance with the principles of the invention discussed earlier.

What is claimed is:

1. In a component of a basketball goal assembly formed of compression molded plastic having an outer periphery and a front face, a sheet of graphics material attached to the front face having an outer peripheral edge and a printed side facing away from the component, the improvement comprising:

a border portion disposed between the outer peripheral edge of the sheet of graphics material and the outer periphery of the component.

2. The basketball component of claim 1, wherein said component comprises a member selected from the group consisting essentially of a basketball backboard and a support member for the basketball goal assembly.

3. The basketball component of claim 2, further comprising a first recess formed in the front face of said component adjacent the outer periphery of said sheet of graphics material.

4. The basketball component of claim 3, wherein said front face includes a border portion defining a surface lying in substantially the same plane as said printed side of said sheet of graphics material, said first recess being located between a peripheral edge of said sheet of graphics material and said border portion.

5. The basketball component of claim 1, wherein said component comprises a basketball backboard and said border portion on said front face surrounding said sheet of graphics material, said border portion including grooves defining a sculpted three-dimensional appearance on said front face.

6. The basketball component of claim 5, wherein said support member comprises a support arm extending between a base and a pole supporting a basketball backboard.

7. In a basketball backboard having a rigid backboard structure formed from compression molded plastic defining a front face including graphics, the improvement comprising:

a border area surrounding said graphics; and at least one first recess defining a sculpted three-dimensional appearance in said front face, said at least one first recess being formed in said border area during molding of the backboard structure.

8. The basketball backboard of claim 7, wherein said at least one recess comprises a peripheral groove disposed on said front face around said graphics, thereby defining an inner boundary of said border area.

9. The basketball backboard of claim 8, further comprising at least one second recess disposed at an angle relative to said first recess.

10. The basketball backboard of claim 7, wherein said graphics comprises a printed graphics sheet.

* * * * *